US006296461B1

(12) United States Patent
Stosic

(10) Patent No.: US 6,296,461 B1
(45) **Date of Patent: *Oct. 2, 2001**

(54) PLURAL SCREW POSITIVE DISPLACEMENT MACHINES

(75) Inventor: Nikola Rudi Stosic, Barnet (GB)

(73) Assignee: City University, London (GB)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/180,824

(22) PCT Filed: May 15, 1997

(86) PCT No.: PCT/GB97/01333

§ 371 Date: Nov. 12, 1998

§ 102(e) Date: Nov. 12, 1998

(87) PCT Pub. No.: WO97/43550

PCT Pub. Date: Nov. 20, 1997

(30) Foreign Application Priority Data

May 16, 1996 (GB) ..... 9610289

(51) Int. Cl.[7] ..... F04C 18/00
(52) U.S. Cl. ..... 418/201.3; 418/201; 29/888.023
(58) Field of Search ..... 418/201.3, 201; 29/888.023

(56) References Cited

U.S. PATENT DOCUMENTS

| | | | | |
|---|---|---|---|---|
| 3,666,384 | | 5/1972 | Amosov et al. . | |
| 4,053,263 | * | 10/1977 | Ingalls | 418/201 |
| 4,109,362 | * | 8/1978 | Ingalls | 418/201 |
| 4,643,654 | | 2/1987 | Rinder . | |
| 4,938,672 | * | 7/1990 | Ingalls | 418/201 |

FOREIGN PATENT DOCUMENTS

| | | |
|---|---|---|
| 0 053 342 A2 | 6/1982 | (EP) . |
| 0 174 081 A2 | 3/1986 | (EP) . |
| 0 166 531 B1 | 3/1989 | (EP) . |
| 1 197 432 | 7/1970 | (GB) . |
| 1 503 488 | 3/1978 | (GB) . |
| 2 106 186 | 4/1983 | (GB) . |
| 2 112 460 | 7/1983 | (GB) . |
| 2 092 676 | 9/1984 | (GB) . |

* cited by examiner

*Primary Examiner*—Thomas Denion
*Assistant Examiner*—Thai-Ba Trieu
(74) *Attorney, Agent, or Firm*—Flynn, Thiel, Boutell & Tanis, P.C.

(57) ABSTRACT

Helical intermeshing main and gate rotors (1, 2) are mounted for rotation about their axes in respective intersecting bores in a housing. The profiles of the rotors as seen in cross section are generated by the same rack formation. The high pressure flanks of the lobes of the main rotor (1) and of the grooves of the gate rotor (2) are both generated by a preferably cycloidal portion (GHA) of the rack R.

21 Claims, 4 Drawing Sheets

PLURAL SCREW POSITIVE DISPLACEMENT MACHINES

FIELD OF THE INVENTION

The present invention relates to plural screw positive displacement machines comprising a housing having at least two intersecting bores the axes of which are coplanar in pairs, and usually parallel, and male and female rotors mounted for rotation about their axes which coincide one with each of the housing bore axes. The rotors each have helical lands which mesh with helical grooves between the lands of at least one other rotor, the or each male rotor having as seen in cross section a set of lobes corresponding to the lands and projecting outwardly from its pitch circle. Each female rotor has as seen in cross section a set of depressions extending inwardly of its pitch circle and corresponding to the grooves of is the female rotor(s). The number of lands and grooves of the male rotor(s) being different to the number of lands and grooves of the female rotor(s).

BACKGROUND OF THE INVENTION

Examples of such machines, which may be used as compressors or expanders are disclosed in GB 1,197,432, GB 1,503,488 and GB 2,092,676.

SUMMARY OF THE INVENTION

A plural screw positive displacement machine according to the invention is characterised in that, the profiles of at least those parts of the lobes projecting outwardly of the pitch circle of the male rotor(s) and the profiles of at least the depressions extending inwardly of the pitch circle of the female rotor(s) are generated by the same rack formation. The lobes are curved in one direction about the axis of the male rotor(s). The depressions are curved in the opposite direction about the axis of the female rotor(s). The portion of the rack which generates the higher pressure flanks of the rotors being generated by rotor conjugate action between the rotors.

Advantageously, a portion of the rack, preferably that portion which forms the higher pressure flanks of the rotor lobes, has the shape of a cycloid. Alternatively, this portion may be shaped as a generalized parabola, for example of the form: $ax+by^q=1$.

Normally, the bottoms of the grooves of the male rotor(s) lie inwardly of the pitch circle as "dedendum" portion and the tips of the lands of the female rotor(s) extend outwardly of its pitch circle as "addendum" portions. Preferably, these dedendum and addendum portions are also generated by the rack formation.

BRIEF DESCRIPTION OF THE DRAWINGS

The invention will now be described by way of example with is reference to the drawings, in which.

DETAILED DESCRIPTION

Figure 1:
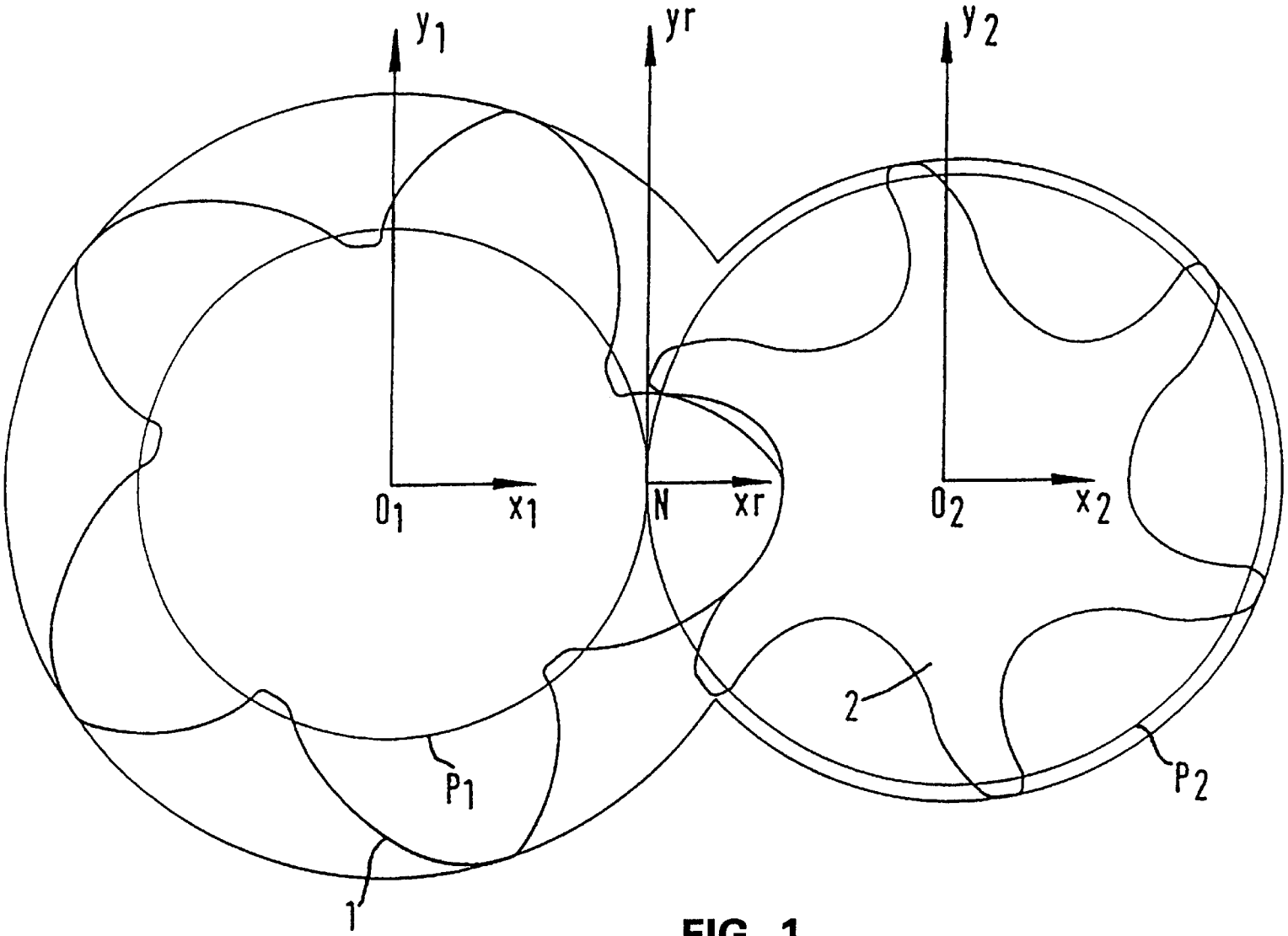
FIG. 1 is a diagrammatic cross section of a twin screw machine.

The main or male rotor 1 and gate or female rotor 2 shown in FIG. 1 rotate in their pitch circles, $P_1$, $P_2$ about their centres $O_1$ and $O_2$ through respective angles $\psi$ and $\tau=Z_1/Z_2\psi=\psi/i$ The pitch circles P have radii proportional to the number of lands and grooves on the respective rotors.

If an arc is defined on either a main or gate rotor as an arbitrary function of an angular parameter $\phi$ and denoted by subscript d:

$$x_d=x_d(\phi) \tag{1}$$

$$y_d=y_d(\phi) \tag{2}$$

the corresponding arc on the other rotor is a function of both $\phi$ and $\psi$:

$$x = x(\phi, \psi) = -a\cos\frac{\psi}{i} + x_d\cos k\psi + y_d\sin k\psi \tag{3}$$

$$y = y(\phi, \psi) = -a\sin\frac{\psi}{i} - x_d\sin k\psi + y_d\cos k\psi \tag{4}$$

$\psi$ is the rotation angle of the main rotor for which the primary and secondary arcs have a contact point. This angle meets the conjugate condition described by Sakun in: "Vintovie kompressori", Mashgiz Leningrad 1960

$$\frac{\delta x_d}{\delta\phi}\frac{\delta y_d}{\delta\psi} - \frac{\delta x_d}{\delta\psi}\frac{\delta y_d}{\delta\phi} = 0 \tag{5}$$

which is the differential equation of an envelope of all "d" curves. Its expanded form is:

$$\frac{\delta y_d}{\delta x_d}\left(\frac{a}{i}\sin\psi - ky_d\right) - \left(-\frac{a}{i}\cos\psi + kx_d\right) = 0 \tag{6}$$

This can be expressed as a quadratic equation of sin $\psi$. Although it can be solved analytically, its numerical solution is recommended due to its mixed roots. Once determined, $\psi$ is inserted in (3) and (4) to obtain conjugate curves on the opposite rotor. This procedure requires the definition of only one given arc. The other arc is always found by a general procedure.

These equations are valid even if their coordinate system is defined independently of the rotors. Thus, it is possible to specify all "d" curves without reference to the rotors. Such an arrangement enables some curves to be expressed in a more simple mathematical form and, in addition, can simplify the curve generating procedure.

Figure 2:
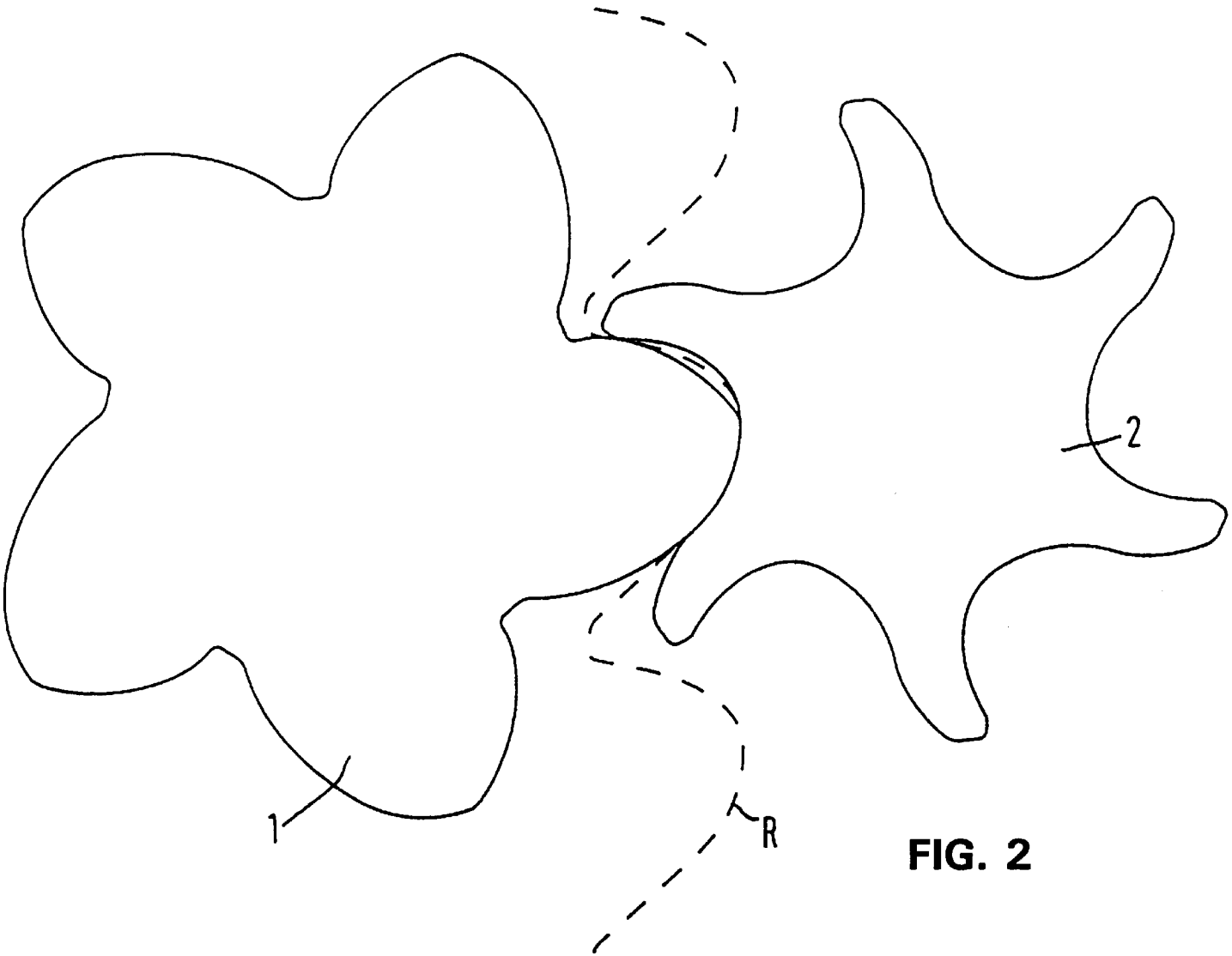
FIG. 2 shows one unit of a rack for generating the profiles of the rotors shown in FIG. 1.

A special coordinate system of this type is a rack (rotor of infinite radius) coordinate system, indicated at R in FIG. 2. An arc on the rack is then defined as an arbitrary function of a parameter $\phi$:

$$x_d=x_d(\phi) \tag{7}$$

$$y_d=y_d(\phi) \tag{8}$$

Secondary arcs on the rotors are derived from this as a function of both, $\phi$ and $\psi$.

$$x=x(\phi,\psi)=x_d\cos\psi-(y_d-r_w\psi)\sin\psi \tag{9}$$

$$y=y(\phi,\psi)+x_d\sin\psi+(y_d-r_w\psi)\cos\psi \tag{10}$$

$\psi$ represents a rotation angle of the rotor where a given arc is projected, defining a contact point. This angle satisfies the condition (5) which is:

$$\frac{dy_d}{dx_d}(r_w\psi - y_d) - (r_w - x_d) = 0 \quad (11)$$

Figure 3:
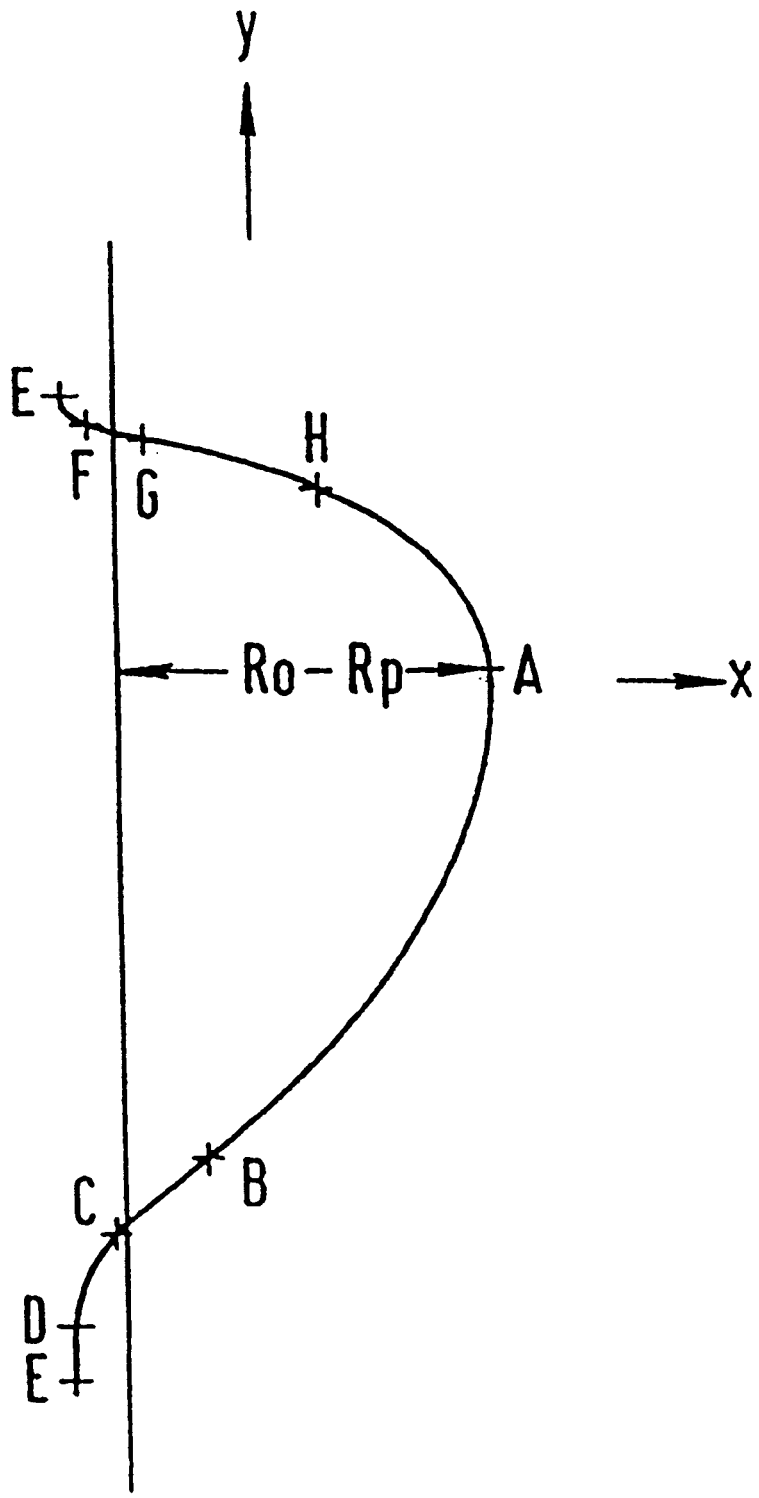
FIG. 3 shows the relationship of the rack formation of FIG. 2 to the rotors shown in FIG. 1.

The explicit solution ψ is then inserted into (9) and (10) to find conjugate arcs on rotors. FIG. 3 shows the rack and rotors generated by the rack.

Wherever curves are given, their convenient form may be:

$$ax_d^p + by_d^q = 1, \quad (12)$$

which is a "general circle" curve. For p=q=2 and a=b=1/r it is a circle, unequal a and b will give ellipses, a and b of opposite sign, hyperbolae, p=1 and q=2 will give parabolae.

In addition to the convenience of defining all given curves with one coordinate system, rack generation offers two advantages compared with rotor coordinate systems: a) a rack profile represents the shortest contact path in comparison with other rotors. This means that points from the rack will be projected onto the rotors without any overlaps or other imperfections, b) a straight line on the rack will be projected onto the rotors as involutes.

In order to minimize the blow hole area on the high pressure side of a rotor profile, the profile is usually produced by a conjugate action of both rotors, which undercuts the high pressure side of them. The practice is widely used; thus in GB-A-1197432, singular points on main and gate rotors were used, in GB-A-2092676 and 2112460 circles, in GB-A-2106186 ellipses were used and in EP-0166531 parabolae were used. An appropriate undercut has not hitherto been achievable directly from a rack. In arriving at the invention, it has been found that there exists only one analytical curve on a rack which can exactly replace the conjugate action of rotors. In accordance with a preferred aspect of the present invention, this is a cycloid, which is undercut as an epicycloid on the main rotor and as a hypocycloid on the gate rotor. This is in contrast to the undercut produced by singular points which produces epicycloids on both rotors. The deficiency of this is usually minimized by a considerable reduction in the outer diameter of the gate rotor within its pitch circle. This reduces the blow-hole area, but also reduces the throughput.

A conjugate action is a process when a point (or points on a curve) on one rotor during a rotation cuts its (their) path(s) on another rotor. An undercut occurs if there exists two or more common contact points at the same time, which produces "pockets" in the profile. It usually happens if small curve portions (or a point) generate long curve portions, when a considerable sliding occurs.

This invention overcomes this deficiency by generating the high pressure part of a rack by a rotor conjugate action which undercuts an appropriate curve on the rack. This rack is later used for the profiling of both the main and gate rotors by the usual rack generation procedure.

The following is a detailed description of a simple rotor lobe shape of a rack generated profile family designed for the efficient compression of air, common refrigerants and a number of process gases, obtained by the combined procedure. This profile contains almost all the elements of modern screw rotor profiles given in the open literature, but its features offer a sound basis for additional refinement and optimisation.

The coordinates of all primary arcs on the rack are summarised here relative to the rack coordinate system.

The lobe of this profile is divided into several arcs. The divisions between the profile arcs are denoted by capital letters and each arc is defined separately, as shown in FIG. 3.

Segment A-B is a general arc of the type $ax_d^p + by_d^q = 1$ on the rack with p=0.43 and q=1.

Segment B-C is a straight line on the rack, p=q=1.

Segment C-D is a circular arc on the rack, p=q=2, a=b.

Segment D-E is a straight line on the rack.

Segment E-F is a circular arc on the rack, p=q=2, a=b.

Segment F-G is a straight line.

Segment G-H is an undercut of the arc $G_2$-$H_2$ which is a general arc of the type $ax_d^p + by_d^q = 1$, p=1, q=0.75 on the main rotor.

Segment H-A on the rack is an undercut of the arc $A_1$-$H_1$ which is a general arc of the type $ax_d^p + by_d^q = 1$, p=1, q=0.25 on the gate rotor.

At each junction A, . . . H, the adjacent segments have a common tangent.

The rack coordinates are obtained through the procedure inverse to equations (7)–(11).

As a result, the rack curve E-H-A is obtained and shown in FIG. 3.

Figure 4:
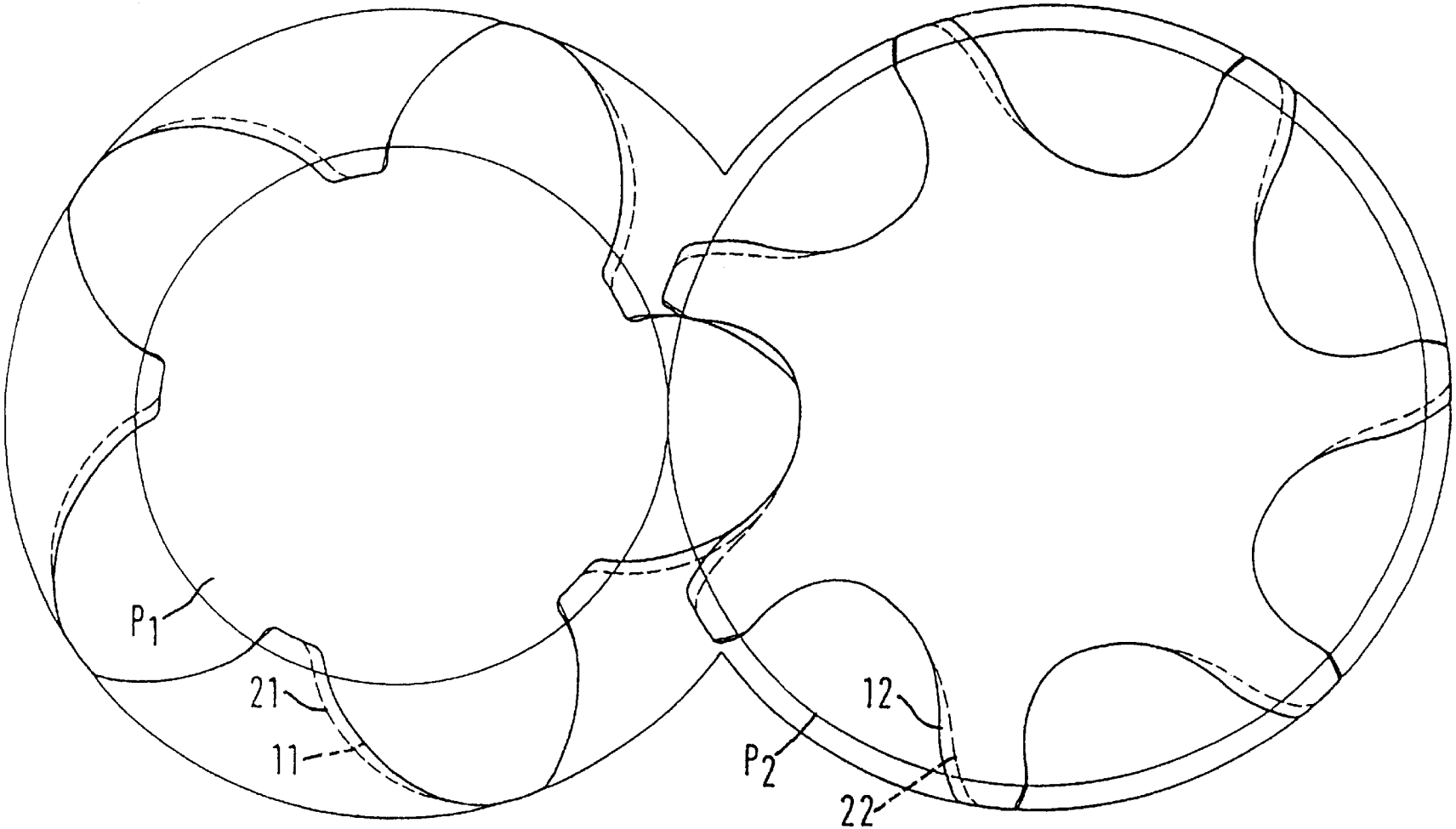
FIG. 4 shows the outlines of the rotors shown in FIG. 3 superimposed on a prior art rotor pair by way of comparison.

FIG. 4 shows the profiles of main and gate rotors 11,12 generated by this rack procedure superimposed on the well-known profiles 21,22 (which are shown by dashed lines) of corresponding rotors generated in accordance with GB-A-2 092 676, in 5/7 configuration.

With the same distance between centres and the same rotor diameters, the rack-generated profiles give an increase in displacement of 2.7% while the lobes of the female rotor are thicker and thus stronger.

In a modification of the rack shown in FIG. 3, the segments GH and HA are formed by a contiuous segment GHA of a cycloid of the form: $y=R_o \cos \tau - R_p$, $y=R_o \sin \tau - R_p\tau$, where $R_o$ is the outer radius of the main rotor (and thus of its bore) and $R_p$ is the pitch circle radius of the main rotor.

The segments AB, BC, CD, DE, EF and FG are all generated by equation (12) above. For AB, a=b, p=0.43, q=1. For the other segments, a=b=1/r, and p=q=2. The values of p and q may vary by ±10%. For the segments BC, DE and FG r is greater than the pitch circle radius of the main rotor, and is preferably infinite so that each such segment is a straight line. The segments CD and EF are cicular arcs when p=q=2, of curvature a=b.

What is claimed is:

1. A plural screw, positive displacement machine, said machine comprising:

a housing having at least two intersecting bores; and a male rotor and a female rotor mounted for rotation in said housing wherein, each said rotor has an axis and a pitch circle that extends around the axis and wherein:

each said rotor is located in a separate one of the bores of said;

said male rotor is formed with a plurality of circumferentially spaced apart lobes, each said lobe extending outwardly beyond the pitch circle of said male rotor and helically along said male rotor;

said female rotor is formed with a plurality of circumferentially spaced apart lobes that define depressions that extend inwardly from an outer surface of said female rotor and inwardly relative to the pitch circle of said female rotor and helically along said female rotor;

said housing is shaped and said rotors are positioned so that said lobes of said male rotor mesh into the depressions of said female rotor; and said lobes of said male rotor are defined by curving a rack about the axis of said male rotor and the depressions of said female rotor are defined by curving the rack around the axis of said female rotor and the rack has a cycloidal portion which defines a major portion of a first flank of each said lobe of each said rotor.

2. The machine according to claim 1, wherein:

said male rotor is shaped so that said lobes of said male rotor include portions that extend inwardly of the pitch circle of said male rotor and that are defined by the rack; and said female rotor is shaped so that said lobes of said female rotor include portions that extend outwardly of the pitch circle of said female rotor and that are defined by the rack.

3. The machine according to claim 2, wherein:

said male rotor has a root surface located between adjacent pairs of said lobes of said male rotor;

each said lobe of said female rotor has a tip section; and said rack further includes a portion that defines the root surfaces of said male rotor and the tip section of said lobes of said female rotor and the portion has a curvature of the type $ax^p + by^q = 1$, wherein: $p = q = 2 \pm 10\%$; and $a = b$.

4. The machine according to claim 2, wherein said rack sequentially comprises:

the cycloid profile portion, wherein the cycloid profile portion extends outwardly away from a tangent to the pitch circle of said male rotor that defines the first flanks of said lobes of said male rotor;

a first curved portion which defines second flanks of said lobes of said male rotor opposite the first flanks, the first curved portion extending inwardly toward the tangent to the pitch circle of said male rotor;

a first straight line portion that intersects the tangent to the pitch circle of said male rotor;

a second straight line portion;

a third curved portion that defines root surfaces of said male rotor and tip sections of said lobes of said female rotor; and a third straight line portion, wherein the third straight line portion intersects the tangent to the pitch circle of said male rotor and connects to the cycloid profile portion.

5. The machien according to claim 1, wherein the flanks of said lobes of said male rotor defined by the cycloidal portions of the rack are high pressure flanks.

6. The machine according to claim 1, wherein said male rotor and said female rotor are formed so that the number of lobes of said male rotor and the number of depressions defined by said lobes of said female rotor are different.

7. A plural screw, positive displacement machine, said machine comprising:

a housing having at least two intersecting bores; and a male rotor and a female rotor mounted for rotation in said housing wherein, each said rotor has an axis and a pitch circle that extends around the axis and, wherein:

each said rotor is located in a separate one of the bores of said housing;

said male rotor is formed with a plurality of circumferentially spaced apart lobes, each said lobe extending outwardly beyond the pitch circle of said male rotor and helically along said male rotor;

said female rotor is formed with a plurality of circumferentiallly spaced apart lobes that define depressions that extend inwardly from an outer surface of said female rotor, inwardly relative to the pitch circle of said female rotor and helically along said female rotor and said female rotor is formed with a number of said lobes so that the number of depressions defined by said lobes is different than the number of said lobes formed on said male rector;

said housing is shaped and said rotors are positioned so that said lobes of said male rotor mesh into the depressions of said female rotor; and said male rotor and said female rotor are shaped so that: portions of said lobes of said male rotor extend both outwardly and inwardly of the pitch circle of said make rotor; portions of said lobes of said female rotor extend both outwardly and inwardly of the pitch circle of said female rotor; and said lobes of said male and female rotors are defined by the same rack, wherein, said lobes of said male rotor are defined by curving the rack about the axis of said male rotor and the depressions of said female rotor are defined by curving the rack around the axis of said female rotor and the rack has a portion which defines high pressure flanks of said lobes of said male rotor and said female rotor that is generated by a conjugate action between said rotors, and the portions of said lobes of said male rotor that extend inwardly of the pitch circle of the male rotor and the portions of said lobes of said female rotor that extend outwardly of the pitch circle of said female rotor are defined by the rack.

8. The machine of claim 7, wherein the portion of the rack which defines the sections of the lobes of said male rotor that lie inwardly of the pitch circle of the male rotor has:

a first curved section that extends from below a tangent to the male rotor pitch circle;

a straight line section that extends from the first curved section, wherein the straight line section extends tangentially from the first curved section; and a second curved section that extends from the straight line section towards a point on the tangent to the male rotor pitch circle, poing being from the first curved section and, at the point the second curved section extends from the straight line section, the straight line segment is tangential to the second curved section.

9. The machine according to claim 7, wherein said rack sequentially comprises:

a cycloidal profile portion that extends outwardly away from the pitch circle of said male rotor that defines the high pressure flanks of said lobes of said male rotor;

a first curved portion which defines second flanks of said lobes of said male rotor opposite the high pressure flanks and that extends inwardly toward a tangent to the pitch circle of said male rotor;

a first straight line portion that intersects the tangent to the pitch circle of said male rotor;

a second curved portion that curves back toward the tangent to the pitch circle of said male rotor;

a second straight line portion;

a third curved portion that defines root surfaces of said male rotor and tip sections of said lobes of said female rotor; and a third straight line portion, wherein the third straight line portion intersects the tangent to the pitch circle of said male rotor and connects to the cycloidal profile portion.

10. The machine according to claim 7, wherein the rack has a generalized parabolic portion that defines a portion of the high pressure flanks of said lobes of said male rotor and the generalized parabolic portion has an arcuate section proximal to a tangent to the pitch circle of said male rotor having a curvature of the type $ax+by^q=1$, where $q=0.75$.

11. The machine according to claim 7, wherein the rack has a generalized parabolic portion that defines a portion of the high pressure flanks of said lobes of said male rotor and the generalized parabolic portion has an arcuate section distal from a tangent to the pitch circle of the male rotor that a curvature of the type $ax+by^q=1$, where q=0.25.

12. A plural screw, positive displacement machine, said machine comprising:

a housing having at least two intersecting bores; and a male rotor and a female rotor mounted for rotation in said housing wherein, each said rotor has an axis and a pitch circle that extends around the axis and, wherein:

each said rotor is located in a separate one of the bores of said housing;

said male rotor is formed with a plurality of circumferentially spaced apart lobes, each said lobe extending outwardly beyond the pitch circle of said male rotor and helically along said male rotor;

said female rotor is formed with a plurality of circumferentially spaced apart lobes that define depressions that extend and inwardly relative to the pitch circle of said female rotor and helically along said female rotor and said female rotor is formed with a number of said lobes so that the depressions defined by said lobes are different in number than the number of said lobes formed said male rotor;

said housing is shaped and said rotors are positioned so that said lobes of each said male rotor mesh into the depressions of said female rotor with which said male rotor is adjacent; and said male rotor and said female rotor are shaped so that portions of said lobes of said male rotor extending beyond the pitch circle of said male rotor and portions of said lobes of said female rotor extending inwardly from the pitch circle of said female rotor are defined by the same rack, wherein, said lobes of said male rotor are defined by curving the rack about the axis of said male rotor and the depressions of said female rotor are defined by curving the rack around the axis of said female rotor and the rack has a portion which defines high pressure flanks of said lobes of said male rotor that is generated of said lobes of said male rotor that is generated by a conjugate action between the rotors and a portion that defines the portions of said lobes that extend outwardly of the pitch circle of said male rotor that collectively have:

a first straight line section that extends outwardly from a first point equivalent to the perimeter of the pitch circle of said male rotor;

a first curved section that extends from the first straight line section, the firs t curved section of the type $ax^p+by^q=1$, where p=0.43;

a second curved section that extends from the first curved section, the second curved section of the type $ax-by^q=1$, where q=0.25;

a third curved section that extends from the second curved section, the third curved section of the type $ax+by^q=1$, where q=0.75; and a second straight line section that extends from the third curved section to a second point equivalent to the perimeter of the pitch circle of said male rotor, the second point being spaced from the first point.

13. The machine according to claim 12, wherein:

said male rotor is formed so that said lobes thereof extend inwardly of the pitch circle of said male rotor;

said female rotor is formed so that said lobes thereof extend outwardly of the pitch circle of said female rotor; and portions of said lobes of said male rotor that extend inwardly of said pitch circle of said male rotor and portions of said lobes of said female rotor that extend outwardly of the pitch circle of said female rotor are defined by the rack and the portion of the rack that defines the portions of the lobes which end inwardly of the pitch circle of said male rotor has:

a fourth curved section which extends from an extension of the first straight line segment;

a third straight line section which extends from the fourth curved section which, at the point the third straight line section extends from the fourth curved section is tangential to the fourth curved section; and a fifth curved section which extends from the third straight line section and is directed toward an extension of the second straight line section, wherein, at the point the fifth curved section extends from the third straight line section, the third straight line section is tangential to the fifth curved section.

14. A plural screw, positive displacement machine, said machine comprising:

a housing having at least two intersecting bores; and a male rotor and a female rotor mounted for rotation in said housing wherein, each said rotor has an axis and a pitch circle that extends around the axis and, wherein:

each said rotor is located in a separate one of the bores of said housing;

said male rotor is formed with a plurality of circumferentially spaced apart lobes, each said lobe extending outwardly beyond the pitch circle of said male rotor and helically along said male rotor;

said female rotor is formed with a plurality of circumferentially spaced apart lobes that define depressions that extend inwardly from an outer surface of said female rotor and inwardly relative to the pitch circle of said female rotor and helically along said female rotor and said female rotor is formed with a number of said lobes so that the depressions defined by said lobes are different in number than the number of lobes of said male rotor;

said housing is shaped and said rotors are positioned so that said lobes of said male rotor mesh into the depressions of said female rotor; and said male rotor and said female rotor are shaped so that portions of said lobes of said male rotor extending beyond the pitch circle of said male rotor and portions of said lobes of said female rotor extending inwardly from the pitch circle of said female rotor are defined by the same rack wherein, said lobes of said male rotor are defined by curving the rack about the axis of said male rotor and the depressions of said female rotor are defined by curving the rack around the axis of said female rotor and the rack has:

a portion which defines high pressure flanks of said lobes of said male and female rotors the portion having a generalized parabolic profile; and a portion which defines flanks of said lobes of said male rotor opposite the high pressure flanks that has a curvature of the type $ax^p+by^q=1$, wherein: p=0.43±10%; 1±10%; and a=b.

15. The machine according to claim 14, wherein:

said male rotor has a root surface located between adjacent pairs of said lobes of said male rotor;

each said lobe of said female rotor has tip section; and said rack further includes a portion that defines the root surfaces of said male rotor and the tip sections of said lobes of aid female rotor, and the portion has a curvature of the type $ax^p+by^q=1$, wherein: $p=q=2\pm10\%$; and $a=b$.

16. The machine according to claim 14, wherein:

said male rotor has rotor surfaces located between said male rotor lobes;

each said lobe of said female rotor has a tip section; and said rack sequentially comprises:

the generalized parabolic profile portion;

the portion which defines flanks of said lobes of said male rotor opposite the high pressure flanks;

a first straight line portion;

a first curved portion;

a second straight line portion;

the portion that defines root surfaces of said male rotors and tip sections of said lobes of said female rotor; and a third straight line portion, wherein the third straight line portion connects to the generalized parabolic profile portion.

17. The machine according to claim 14, wherein:

said male rector is shaped so that said libes of said male rotor extend inwardly of the pitch circle of said male rotor and are defined by the rack; and said female rotor is shaped so that said lobes of said female rotor extend outwardly of the pitch circle of said female rotor and are defined by the rack.

18. The machine according to claim 14, wherein the generalized parabolic portion of the rack has an arcuate section proximal to the pitch circle of said male rotor having a curvature of the type $ax+by^q=1$, where $q=0.75$.

19. The machine according to claim 14, wherein the generalized parabolic portion of the rack adjacent the portion of the rack formation that defines the opposed flanges has an arcuate section having a curvature of the type $ax+by^q=1$, where $q=0.25$.

20. A plural screw, positive displacement machine, said machine comprising:

a housing having at least two intersecting bores; and a male rotor and a female rotor mounted for rotation in said housing wherein, each said rotor has an axis and a pitch circle that extends around the axis and:

each said rotor is located in a separate one of the bores of said housing;

said male rotor is formed with a plurality of circumferentially spaced apart lobes, each said lobe extending outwardly beyond the pitch circle of said male rotor and helically along said male rotor;

said female rotor is formed with a plurality of circumferentially spaced apart lobes that define depressions that extend inwardly from an outer surface of said female rotor and inwardly relative to the pitch circle of said female rotor and helically along said female rotor;

said housing is shaped so that said lobes of said male rotor mesh into the depressions of said female rotor; and said lobes of said male rotor are defined by curving a rack about the axis of said male rotor and the depressions of said female rotor are defined by curving the rack has a curved portion which defines a major portion of a first flank of each said lobe of said rotor and the curved portion has:

an arcuate section proximal to the pitch circle of said male rotor having a curvature the type $ax+by^q=1$, where $q=0.75$; and an arcuate section distal to the pitch circle of said male rotor having a curvature of the type $ax+by^q=1$, where $q=0.25$.

21. A plural screw, positive displacement machine, said machine comprising:

a housing having at least two intersecting bores; and a male rotor and a female rotor mounted for rotation in said housing wherein, each said rotor has an axis and a pitch circle that extends around the axis and:

each said rotor is located in a separate one of the bores of said housing;

said male rotor is formed with a plurality of circumferentially spaced apart lobes, each said lobe extending outwardly beyond the pitch circle of said male rotor and helically along said male rotor;

said female rotor is formed with a plurality of circumferentially spaced apart lobes that define depressions that extend inwardly from an outer surface of said female rotor and inwardly relative to the pitch circle of said female rotor and helically along said female rotor;

said housing is shaped so that said lobes of said male rotor mesh into the depressions of said female rotor; and said male rotor and said female rotor are shaped so that portions of said lobes of said male rotor that extend beyond the pitch circle of said male rotor and portions of said lobes of said female rotor extending inwardly from the pitch circle of said female rotor are defined by curving the rack around the axis of said male rotor and the depressions of said female rotor being defined by curving the rack around the axis of the female rotor, the rack having a portion that defines high pressure flanks of said lobes of said male rotor that is generated by a conjugate action between said rotors and a portion of the rack that defines the portions of said lobes that extend outwardly of the pitch circle of said male rotor, has:

a first straight line section that extends outwardly from a first point equivalent to the perimeter of the pitch circle of said male rotor;

a first curved section that extends from the first straight line section, the first curved section of the type $ax^p+by^q=1$, where $p=0.43$;

a second curved section that extends from the first curved section, the second curved section having a cycloidal profile; and a second straight line section that extends from the second curved section to a second point equivalent to the perimeter of the pitch circle of said male rotor, the second point being spaced from the first point.

* * * * *